US005860569A

United States Patent [19]

Gregoire

[11] Patent Number: 5,860,569

[45] Date of Patent: Jan. 19, 1999

[54] PRODUCT-DISPENSING CONTAINER

[75] Inventor: Jean-François Gregoire, Offranville, France

[73] Assignee: Carnaudmetalbox Sante-Beaute, Saint-Ouen, France

[21] Appl. No.: 873,172

[22] Filed: Jun. 11, 1997

[30] Foreign Application Priority Data

Jun. 13, 1996 [FR] France ..... 96 07371

[51] Int. Cl.[6] ..... B67D 5/56; B67D 5/52; B67D 5/60

[52] U.S. Cl. ..... 222/129; 222/142.1; 222/142.2; 222/145.1

[58] Field of Search ..... 222/129, 145.1, 222/142.1, 142.2

[56] References Cited

U.S. PATENT DOCUMENTS

| | | | |
|---|---|---|---|
| 4,105,142 | 8/1978 | Morris, Jr. | 222/158 |
| 4,757,916 | 7/1988 | Goncalves | 222/129 |
| 4,950,237 | 8/1990 | Henault et al. | 222/129 |
| 5,071,034 | 12/1991 | Corbiere | 222/129 |
| 5,088,627 | 2/1992 | Musel | 222/145 |
| 5,353,961 | 10/1994 | Debush | 222/129 |
| 5,383,579 | 1/1995 | Lanfranconi et al.. | 222/128 |
| 5,447,226 | 9/1995 | Laine | 222/129 |

FOREIGN PATENT DOCUMENTS 260 179 3/1988 European Pat. Off. ..... B65D 81/32

*Primary Examiner*—Andres Kashnikow
*Assistant Examiner*—Keats Quinalty
*Attorney, Agent, or Firm*—Wenderoth, Lind & Ponack, L.L.P.

[57] ABSTRACT

A container includes a body (12) delimiting a first chamber (20), intended to contain a first product, and a second chamber (22) intended to contain a second product. The second chamber is connected to the first chamber by a product-flow passage (24). A device (26) is provided for obturating the passage (24). The obturating device is mounted so as to be able to move axially between a first position for obturating the passage (24) and a second position for freeing the passage (24) for the purpose of mixing the products. Also, a product-dispensing device (50) is mounted on the container. The obturating device (26) is borne by the wall of one of the chambers (22). The wall includes an extensible region (46) which, during its extension, acts to free the passage (24). Further, the container includes a removable skirt (54) for holding the obturating device (26) in the obturating position.

12 Claims, 3 Drawing Sheets

PRODUCT-DISPENSING CONTAINER

BACKGROUND OF THE INVENTION

The present invention relates to a product-dispensing container which allows extemporaneous mixing of products, in particular of cosmetic or pharmaceutical products.

Extemporaneous mixing is mixing of products which have a limited preservation time and the constituents of which are mixed together only at the moment when the container is first used.

For this purpose, it is usual in the case of mixing two products to keep each of the products in a separate chamber of a container. The chambers are brought into communication with each other at the moment when the container is first used.

Such product-dispensing containers are known, and are of the type which comprises a body delimiting a first chamber intended to contain a first product and a second chamber intended to contain a second product and connected to the first chamber by a passage for permitting product to flow between the chambers. Also included is a device for obturating the passage. The obturating device is mounted so as to be able to move axially in the body between a first position for obturating the passage and a second position for freeing the passage for the purpose of mixing the products. Also, a product-dispensing means is associated with one of the chambers.

In the dispensing containers of this type, the obturating device operates by applying a force on an elastically deformable membrane which is placed inside one of the chambers and against which the obturating device passes.

These containers have many drawbacks, in particular, because of the fact that they consist of an assembly of at least four pieces, it is relatively expensive to produce them in a manufacturing line at a high production rate.

The object of the present invention is to overcome this drawback and to provide a product-dispensing container consisting of a relatively small number of pieces.

SUMMARY OF INVENTION

The subject of the invention is therefore a container of the aforementioned type, characterized in that since the obturating device is borne by the wall of one of the chambers, the wall includes an extensible region intended, during its extension, to free the passage, and in that it includes removable means for holding the obturating device in the position for obturating the passage.

The container according to the invention may furthermore include one or more following characteristics:

- the extensible region is a bellows formed in the wall of the second chamber and the bellows delimits the extensible region;
- the extensible region includes an elastically deformable device associated with the wall of the second chamber and the elastically device forces the obturating device up into the position for freeing the product-flow passage;
- the wall of the second chamber forms a neck extending on the opposite side from the flow passage and emerging so as to define a product outlet, the edge of which delimits a seat for the obturating device;
- the obturating device includes a stem provided with a first end bearing an obturator proper and an opposite end provided with an annular rim which presses against the seat;

- the obturator is made of an elastically deformable material overmolded onto the stem;
- the stem has a generally cylindrical shape and is provided at its center with a longitudinal product-flow channel and, between the opposite ends thereof, with perforations;
- the container furthermore includes a cap provided with means for fixing it to the neck;
- the cap is provided with a longitudinal product-dispensing duct which is closed off by a separable tip and intended to come into communication with the longitudinal product-flow channel;
- the means for holding the obturating device in the position for obturating the product-flow passage includes an external peripheral skirt connected to the cap by frangible tamper-evident means and provided with an internal flange delimiting a ramp for snap-fastening it onto an external peripheral bead formed in the body; and
- the cap includes an internal sealing skirt intended to mate with the internal surface of the stem.

BRIEF DESCRIPTION OF THE DRAWINGS

Other features and advantages will become apparent from the following description, provided solely by way of example and with reference to the appended drawings in which.

DETAILED DESCRIPTION OF THE INVENTION

Figure 1:
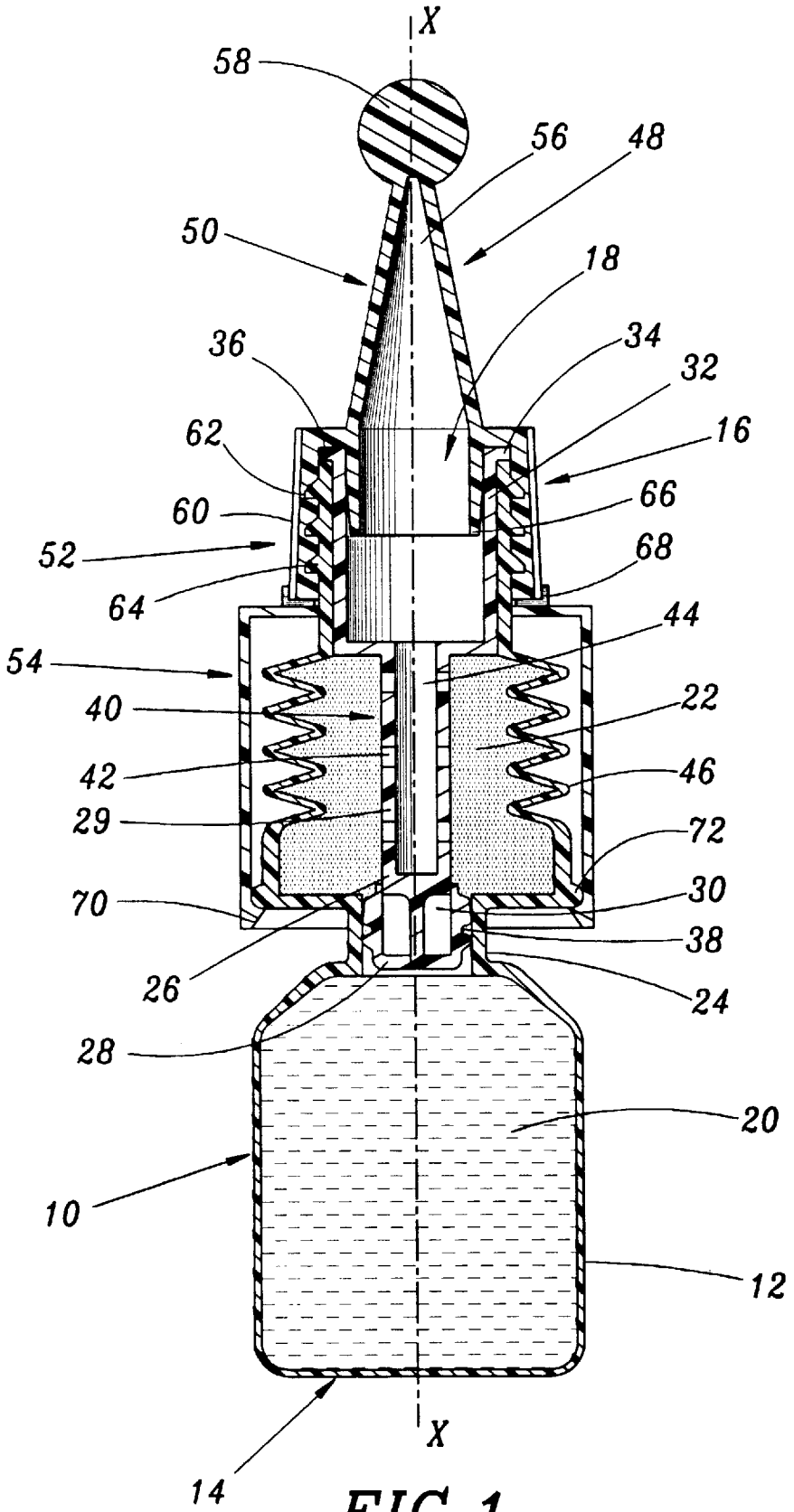
FIG. 1 is a longitudinal sectional view of a container according to the invention in a position at which the product-flow passage is obturated.
Figure 2:
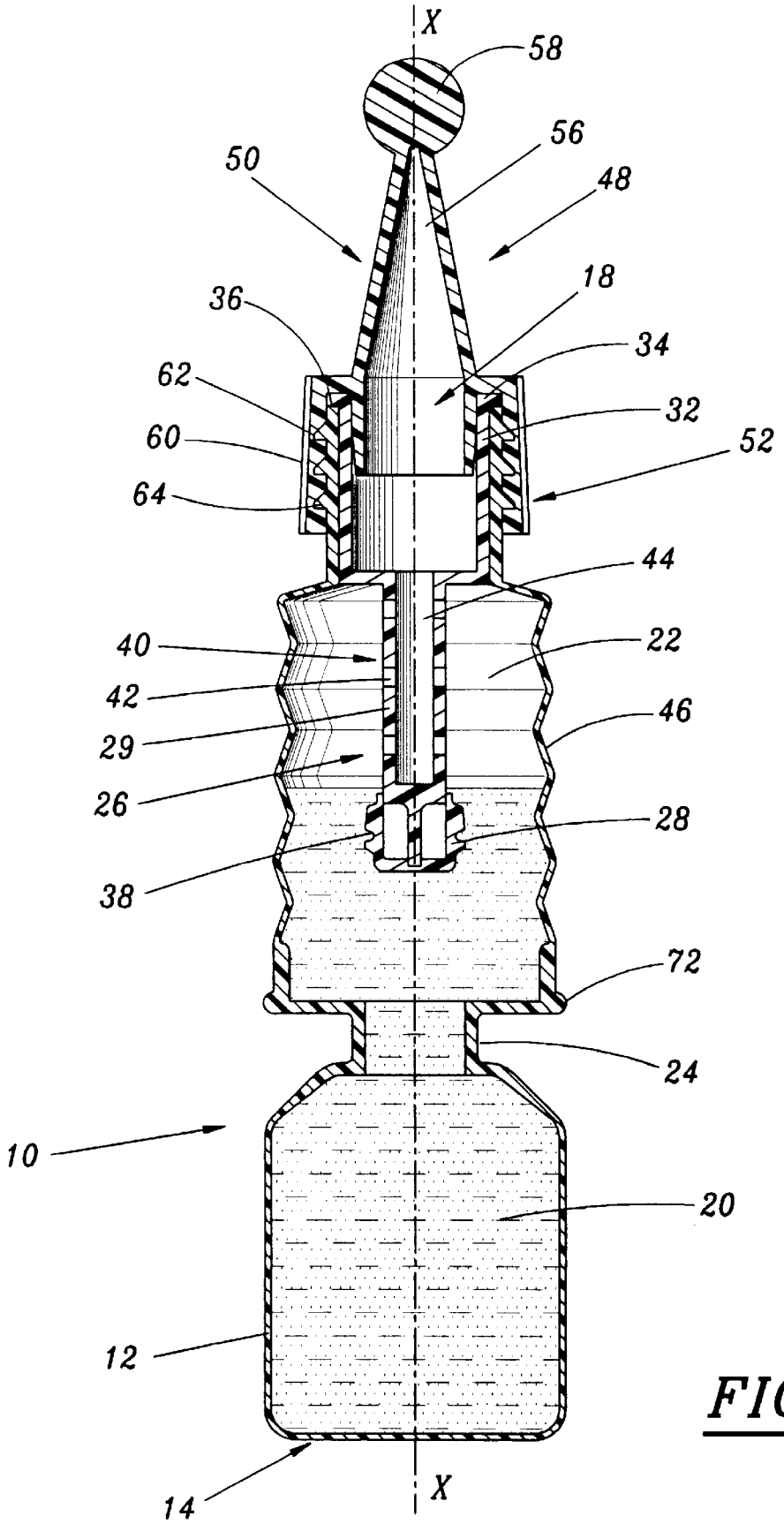
FIG. 2 is a longitudinal sectional view of the bottle shown in FIG. 1, in a position at which the product-flow passage is free.

FIGS. 1 and 2 show a product-dispensing bottle according to the invention, respectively in the storage position and in the use position.

The container, denoted by the general reference 10, has an axis of symmetry X—X, which is assumed to be vertical.

The container 10, made of plastic, mainly polyethylene or polypropylene, has a hollow body 12 provided with a closed, lower or rear end 14 and with an open, upper or front end 16 forming a neck emerging in a mouth 18.

The hollow body 12 delimits a first chamber 20 containing a first product, for example a solvent, and a second chamber 22 containing a second product, for example a substance in the form of a powder intended to be mixed with the solvent when the container is put into use.

The first chamber 20 and second chamber 22 are connected by a product-flow passage 24 consisting of a narrowing in the cross-section of the body 12. This product-flow passage 24 is obturated, in the storage position of the container 10, by an obturating device 26 which is mounted so as to be able to move axially in the body 12, parallel to the axis of symmetry X—X, between a first position for obturating the passage 24, as shown in FIG. 1, and a second position for freeing the passage 24, as shown in FIG. 2.

The obturating device 26 includes an obturator 28 proper and of a stem 29 for operating the latter. The stem 29 is generally cylindrical in shape and extends into the second cavity 22 along the X—X.

The stem 29 has a cylindrical general shape and has a first, closed lower end region 30 to which the obturator 28 is fixed and a second, open upper end region 32. An end face of region 32 is provided with an annular rim 34 which presses against a seat 36 formed by the free edge of the neck 16.

The obturator 28 is formed of an elastically deformable material, such as an elastomer, and has a cross-section, at rest, which is substantially greater than the internal diameter of the product-flow passage 24 so as to provide an effective seal in order to prevent communication between the first chamber 20 and the second chamber 22 during storage of the container 10.

On its external peripheral surface, the obturator 28 has surface irregularities 38 in order to allow, the passage 24 to be easily freed when the container is put into use.

Further, the stem 29 has a central region 40 provided with perforations 42 and, at its center, defines a longitudinal product-flow channel 44 extending along the central region 40 and the upper end region 32.

The perforations 42 bring the second chamber 22 into communication with the product-flow channel 44.

FIGS. 1 and 2 also show that the wall of the body 12 delimiting the second chamber 22 includes an extensible region 46 consisting of an elastically deformable bellows.

The bellows 46 act as a spring and is in the stressed state in the storage position of the container 10 and in the unstressed state in the use position of the container 10.

FIGS. 1 and 2 show that the container 10 is provided with a cap 48 which has an upper end region 50, a central region 52 and a lower end region 54.

The upper end region 50 has a substantially conical general shape and delimits, on the inside, a longitudinal product-dispensing duct 56 having a cross-section which uniformly decreases towards the top of the end region 50.

The dimensions of the product-dispensing duct 56 are preferably designed to provide product dispensing drop by drop. It is closed off, downstream with respect to the direction of flow of the product, by a separable spherical tip 58.

The central region 52 of the cap 48 has a substantially frustoconical shape. On its external surface, it is provided with coaxial longitudinal ribs 60 which define an operating surface which can be manually actuated by a user. The central region also has an internal surface, which is provided with a thread 62 which engages with a complementary thread 64 formed in the external peripheral surface of the neck 16.

FIGS. 1 and 2 also show that the central region 52 further includes an internal skirt 66 which extends, upstream, toward the upper end region 50 of the cap 48 and which mates with the internal surface of the stem 29 for the purpose of providing effective sealing between the cap 48 and the stem 29.

Finally, the lower end region 54 of the cap 48 consists of an external skirt having a generally cylindrical shape and connected to the central region 52 by a tearable ring 68. The external skirt of lower end region 54 is provided with two opposed longitudinal lines of lesser mechanical strength (not shown) delimiting two removable semicylindrical regions.

Moreover, the external skirt of the lower end region 54 is provided near its free end with an internal flange 70 which delimits a ramp for snap-fastening onto an external peripheral bead 72 formed on the wall of the body 12.

With regard to the assembly and filling of such a container, first of all, in a filling line, the first chamber 20 of the body 12 is filled with the aid of a filling tube inserted into the first chamber 20.

Figure 3:
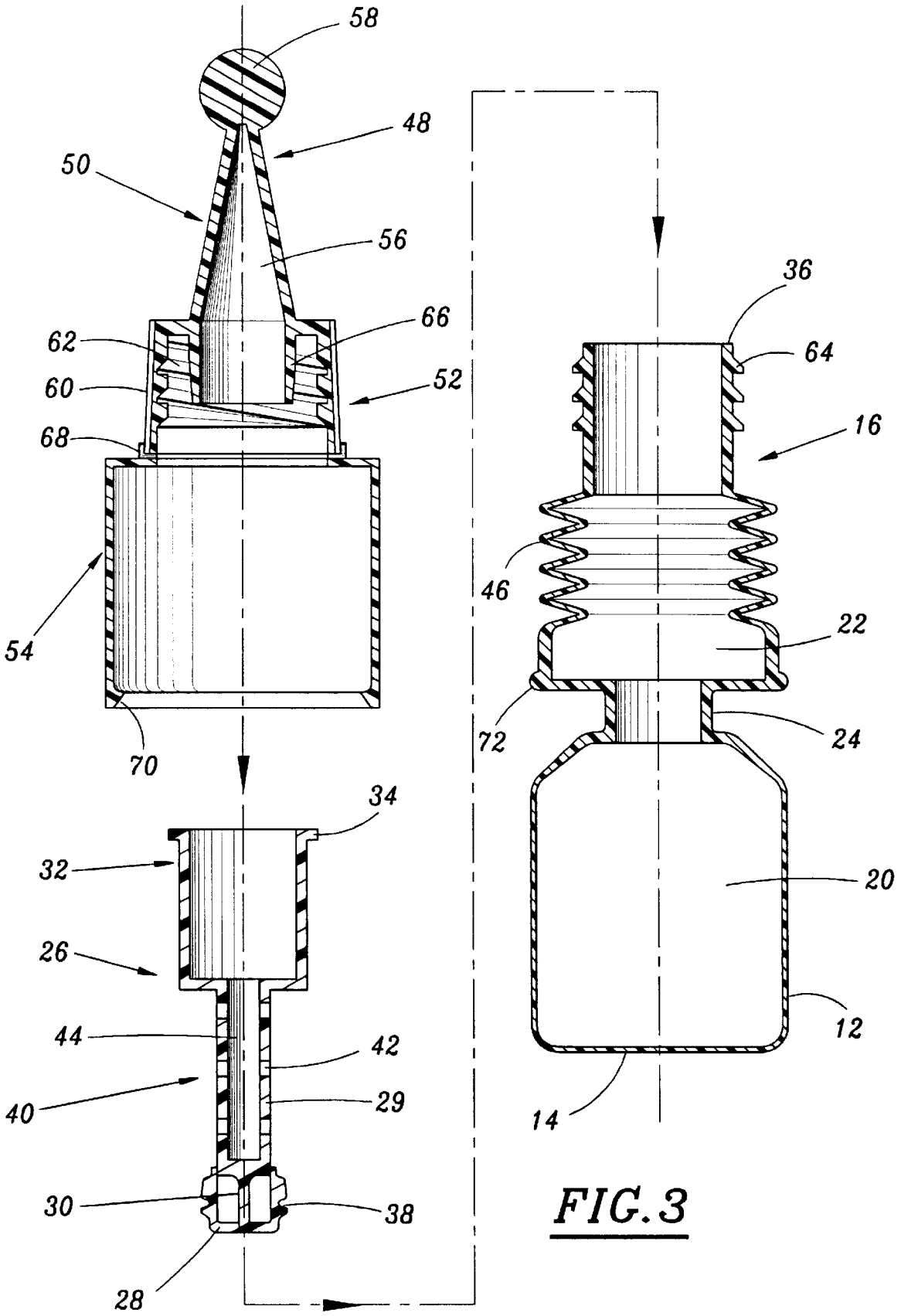
FIG. 3 is an exploded view of the bottle shown in FIGS. 1 and 2.

The filling tube is retracted and the bottle is in the configuration shown in FIG. 3.

Next, the stem 29 equipped with the obturator 28 is positioned in the second chamber 22 so that the peripheral annular rim 34 bears against the seat 36 of the neck 16 and so that the obturator 28 is inserted into the product-flow passage 24 in a sealed manner.

It should be noted that, at this point in the filling process, the bellows 46 is in the stressed state, and the friction force, applied by the obturator 28, on the internal wall of the product-flow passage 24, is exerted against the force applied by the bellows on the stem 29.

A second filling tube is then inserted into the product-flow channel 44 and the second chamber is filled with a second product, which flows through the perforations 42.

The cap 48 is then placed on top of the body 12, which is equipped with the stem 29 and with the obturator 28. The internal skirt 66 of the cap 48 is inserted into the neck 16 and presses against the internal surface of the stem 29.

Next, the cap 48 is screwed onto the neck 16 so that the flange 70 is snap-fastened onto the peripheral bead 72.

The container is then in the position shown in FIG. 1, in which the obturating device 26 is locked in a position obturating the product-flow passage 24 due to the action of the external skirt 54 which is snap-fastened onto the bead 72.

When the container is put into use, as mentioned previously, the two products contained in the chambers 20 and 22 have to be extemporaneously mixed.

To do this, the user tears the tearable ring 68 and separates the two semicylindrical parts of the external skirt 54.

The user then pulls gently on the operating surface of the cap, causing the bellows 46 to extend and the obturating device 26 to move from its storage position, shown in FIG. 1, to its position for freeing the passage 24, shown in FIG. 2.

The user then shakes the bottle so as to achieve effective mixing of the two products.

It should be noted that, in this position, the cap 48 obturates the mouth 18 of the body in a sealed manner.

In order to dispense the mixture, the user breaks off the separable tip 58 and causes the product to flow through the dispensing duct 56 by turning the product upside down and, where appropriate, exerting pressure on the upper end region 50 of the cap 48.

It may be imagined that the container just described allows effective storage of two products which are separately maintained in a corresponding chamber of the container.

Furthermore, since the container consists of three parts, namely the body 12, the obturating device 26 and the cap 48, the container may be manufactured inexpensively in a manufacturing line operating at a high production rate.

In the illustrated embodiment, which has just been described, the product-flow passage 24 is freed by pulling on the operating surface of the cap.

In an embodiment which is not shown, it is possible to provide the container with an elastically deformable device which is associated with the second chamber 22 and which forces the obturating device into the position for freeing the passage.

Consequently, as soon as the external skirt 54 for holding the obturating device in the obturating position is removed, the elastically deformable device automatically frees the passage.

Of course, in this embodiment, in order to fill the second chamber, it is necessary to exert a force on the free edge of the neck so as to keep the bellows in the stressed state, against the force exerted by the elastically deformable device.

According to yet another embodiment, it is possible to provide the neck with a thread of greater length and to provide the external skirt with a complementary internal thread, so that rotation of the skirt causes the bellows to extend.

Consequently, unscrewing the cap makes the container go from the position for obturating the product-flow passage to the position for freeing this passage, thereby causing the bellows to extend.

What is claimed is:

1. A dispensing container comprising:

a body delimiting a first chamber for containing a first product, a second chamber for containing a second product, and a flow passage connecting said first chamber to said second chamber to permit product to flow therebetween, wherein a wall of one of said first and second chambers includes an extensible portion;

a device for obturating said flow passage, said device being mounted so as to be axially movable in said body between a first position in which said flow passage is obturated and a second position in which said flow passage is open such that the products in said first and second chambers can be mixed;

holding means for holding said obturating device in said first position, said holding means being removable to permit said obturating device to move to said second position; and dispensing means supported on one of said first and second chambers, wherein said obturating device is supported by said one of said first and second chambers which includes said extensible portion such that, upon extension of said extensible wall portion, said obturating device is moved from said first position to said second position.

2. The dispensing container as claimed in claim 1, wherein said extensible region comprises a bellows formed in the wall of said second chamber.

3. The dispensing container as claimed in claim 1, wherein said extensible region is elastically deformable.

4. The dispensing container as claimed in claim 1, wherein said second chamber forms a container neck extending in a direction away from said flow passage, said neck defines a product outlet, and said outlet has an edge which delimits a seat receiving said obturating device.

5. The dispensing container as claimed in claim 4, wherein said obturating device includes a stem having a first end connected to an obturator and a second end having an annular rim engaging said seat.

6. The dispensing container as claimed in claim 5, wherein said obturator is formed of an elastically deformable material which is overmolded onto said stem.

7. The dispensing container as claimed in claim 5, wherein said stem has a generally cylindrical shape and is provided with a central longitudinal product flow channel and a plurality of perforations between said first and second ends.

8. The dispensing container as claimed in claim 7, wherein said dispensing means comprises a cap which defines a longitudinal product dispensing duct in communication with said longitudinal product-flow channel, and said longitudinal product dispensing duct is closed by a separable tip.

9. The dispensing container as claimed in claim 7, wherein said dispensing means comprises a cap which includes an internal sealing skirt for mating with an internal surface of said stem.

10. The dispensing container as claimed in claim 4, wherein said dispensing means comprises a hollow cap having means for fixing said cap on said neck.

11. The dispensing container as claimed in claim 10, wherein said cap defines a longitudinal product dispensing duct in communication with said product outlet, and said longitudinal product dispensing duct is closed by a separable tip.

12. The dispensing container as claimed in claim 10, wherein said means for holding said obturating device in said first position comprises an external peripheral skirt connected to said cap by a frangible tamper-indicator, and an internal flange delimiting a ramp for snap-fastening said external peripheral skirt onto an external peripheral bead formed on said body.

* * * * *